US011648746B2

(12) United States Patent
Thunholm

(10) Patent No.: US 11,648,746 B2
(45) Date of Patent: May 16, 2023

(54) ARRANGEMENT AND METHOD FOR HANDLING A LOAD FOR ISOSTATIC PRESSURE TREATMENT

(71) Applicant: Quintus Technologies AB, Vasteras (SE)

(72) Inventor: Roger Thunholm, Vasteras (SE)

(73) Assignee: Quintus Technologies AB, Vasteras (SE)

( * ) Notice: Subject to any disclaimer, the term of this patent is extended or adjusted under 35 U.S.C. 154(b) by 1053 days.

(21) Appl. No.: 16/304,417

(22) PCT Filed: May 18, 2017

(86) PCT No.: PCT/EP2017/061972
§ 371 (c)(1),
(2) Date: Nov. 26, 2018

(87) PCT Pub. No.: WO2017/202683
PCT Pub. Date: Nov. 30, 2017

(65) Prior Publication Data

US 2019/0291373 A1 Sep. 26, 2019

(30) Foreign Application Priority Data

May 25, 2016 (SE) ..... 1650725-3

(51) Int. Cl.
*B30B 11/00* (2006.01)
*B30B 15/02* (2006.01)
*B30B 15/30* (2006.01)

(52) U.S. Cl.
CPC ..... *B30B 11/002* (2013.01); *B30B 15/028* (2013.01); *B30B 15/30* (2013.01)

(58) Field of Classification Search
CPC ..... B30B 11/002; B30B 15/028; B30B 15/30; B30B 11/00; B22F 3/15
See application file for complete search history.

(56) References Cited

U.S. PATENT DOCUMENTS 4,537,569 A * 8/1985 Asari ..... B22F 3/03 425/405.2
4,582,681 A * 4/1986 Asari ..... B22F 3/15 264/517

(Continued)

FOREIGN PATENT DOCUMENTS

CN 2701622 Y 5/2005
CN 104837616 A 8/2015

(Continued)

OTHER PUBLICATIONS

English Translation "Kobe steel, KR20150140574A , Processed Item Transportation System of Isostatic Pressing Apparatus" obtained Dec. 16, 2021 (Year: 2021).*

(Continued)

*Primary Examiner* — Michael M. Robinson
(74) *Attorney, Agent, or Firm* — Harness, Dickey & Pierce, P.L.C.

(57) ABSTRACT

There is provided an arrangement and method for handling a load for isostatic pressure treatment in a high-pressure arrangement. The arrangement comprises a transportation unit arranged in a first space, wherein the transportation unit is configured for horizontal transportation of a pressure vessel comprising the load into the high-pressure arrangement before pressure treatment of the load, and out of the high-pressure arrangement after pressure treatment of the load, respectively. The arrangement further comprises an elevator unit vertically operable between the first space and a second space provided below the first space, wherein the elevator unit is configured to lift the load from the second space into the pressure vessel before pressure treatment of the load, and to lower the load from the pressure vessel to the second space after pressure treatment of the load, respectively.

9 Claims, 5 Drawing Sheets

(56) References Cited

U.S. PATENT DOCUMENTS

| | | | | |
|---|---|---|---|---|
| 4,597,709 | A * | 7/1986 | Yonezawa | B21D 37/14 104/307 |
| 4,993,193 | A * | 2/1991 | Panetti | E01B 31/17 451/347 |

FOREIGN PATENT DOCUMENTS

| | | | |
|---|---|---|---|
| CN | 109476108 | A | 3/2019 |
| CN | 114340884 | A | 4/2022 |
| DE | 2549048 | A1 | 5/1976 |
| EP | 0121627 | A1 | 10/1984 |
| EP | 2832534 | A1 | 2/2015 |
| JP | S4981279 | A | 8/1974 |
| JP | S6092099 | A | 5/1985 |
| JP | S6092099 | U | 6/1985 |
| JP | S62-284703 | A | 12/1987 |
| JP | H01162598 | A | 6/1989 |
| JP | H05306888 | A | 11/1993 |
| JP | 2015229186 | A | 12/2015 |
| JP | 7027344 | B2 | 3/2022 |
| KR | 20150140574 | A | 12/2015 |
| WO | WO-2014060017 | A1 | 4/2014 |
| WO | WO-2017/202683 | A1 | 11/2017 |

OTHER PUBLICATIONS

Japanese Office Action dated Mar. 2, 2021 for corresponding Japanese Application No. 2018-562002, and English-language translation thereof.
Office Action dated Jun. 7, 2021 in Chinese Application No. 201780043287.8.
International Search Report for PCT/EP2017/061972 generated Aug. 21, 2017.
Chinese Office Action dated Mar. 24, 2020 for corresponding Chinese Application No. 201780043287.8.
Japanese Decision of Patent dated Jan. 18, 2022 for corresponding Japanese Application No. 2018-562002.
Chinese Office Action dated Dec. 14, 2020 for corresponding Chinese Application No. 201780043287.8.
Chinese Notice of Grant dated Nov. 16, 2021 for corresponding Chinese Application No. 201780043287.8.
European Communication pursuant to Rules 161(1) and 162 EPC dated Jan. 8, 2019 for corresponding European Application No. 17727819.9.
European Art. 67(3) Communication dated Mar. 13, 2019 for corresponding European Application No. 17727819.9.
European Communication pursuant to Rule 70b(1) dated Aug. 26, 2019 for corresponding European Application No. 17727819.9.
Korean Allowance of Patent dated Mar. 30, 2022 for corresponding Korean Application No. 10-2018-7037532.
Chinese Office Action dated Apr. 18, 2022 for Chinese Application No. 20198010019.4.
English-language Summary of Russian Notification of Passing Formal Examination dated Apr. 4, 2019 for Russian Application No. 2018145540.
Russian Search Report dated Jun. 19, 2020 for corresponding Russian Application No. 2018145540.
Russian Office Action dated Jul. 8, 2020 for corresponding Russian Application No. 2018145540.
Russian Decision of Grant dated Jan. 15, 2021 for corresponding Russian Application No. 2018145540.
Russian Notification that Formal Examination has been Completed dated May 13, 2020 for corresponding Russian Application No. 2018145540.
Chinese Grant Certificate dated Feb. 11, 2022 for corresponding Chinese Application No. 201780043287.8.
Korean Certificate of Patent dated Apr. 6, 2022 for corresponding Korean Application No. 10-2018-7037532.
Russian Patent Certificate dated Mar. 15, 2021 for corresponding Russian Application No. 2018145540.
Japanese Response filed on Sep. 1, 2021 for corresponding Japanese Application No. 2018-562002.
Korean Request for Examination/Amendment dated May 14, 2020 for corresponding Korean Application No. 10-2018-7037532.
Korean Written Argument/Amendment dated Dec. 22, 2021 for corresponding Korean Application No. 10-2018-7037532.
Request for Substantive Examination dated Apr. 28, 2020 for corresponding Russian Application No. 2018145540.
Russian Response to Office Action dated Jul. 8, 2020 for corresponding Russian Application No. 2018145540.

* cited by examiner

ARRANGEMENT AND METHOD FOR HANDLING A LOAD FOR ISOSTATIC PRESSURE TREATMENT

CROSS-REFERENCE TO RELATED APPLICATIONS

This application is a national phase under 35 U.S.C. § 371 of PCT International Application No. PCT/EP2017/061972 which has an International filing date of May 18, 2017, which claims priority to Swedish Application No. 1650725-3 filed May 25, 2016, the entire contents of each of which are hereby incorporated by reference.

FIELD OF THE INVENTION

The present invention relates to the field of high pressure treatment. In particular, the present invention relates to an arrangement for handling a load for isostatic pressure treatment. Also, the invention relates to a method for handling a load for high pressure treatment.

BACKGROUND OF THE INVENTION

Isostatic presses may be used for the production, treatment and/or processing of different types of articles, components and/or elements. The isostatic presses usually comprise a furnace provided with electric heating elements for increasing the temperature in the furnace chamber where the load, i.e. the articles, is being pressed in a loading space.

During a high-pressure pressing operation of a high-pressure press, a pressure medium, which is accommodated in a pressure chamber of a pressure vessel, is pressurized to a very high pressure. The pressure medium is often a fluid gaseous medium, e.g. argon gas. If the high-pressure press exerts an equal pressure on every side of the contents in the pressure vessel, the press is called an isostatic press. Depending on the temperature of the pressure medium during an isostatic pressing process, the process can be called hot isostatic pressing or HIP (hereinafter referred to as HIP).

HIP has established itself in the past decades as a competitive and proven manufacturing process for the production of components made from a wide range of metals and/or ceramics, wherein the components are used in a number of industry sectors such as the aerospace, offshore, energy and medical sector. The gas pressure acts uniformly in all directions to provide isostatic properties and a very high degree of material densification. HIP is for instance used in achieving elimination of porosity in castings, such as for instance turbine blades, in order to substantially increase their service life and strength, in particular the fatigue strength. The HIP technology may furthermore be used for the compaction of metal powders (powder metallurgy HIP or PM HIP) in a container.

HIP provides many benefits and has become a viable and high performance alternative and/or complement to conventional processes such as forging, casting and machining. The HIP technology may be used for the compaction of metal powders (powder metallurgy HIP or PM HIP) in a container.

It will be appreciated that the there is a wish to produce, treat and/or process increasingly larger articles, components and/or elements by isostatic pressing. For example, in the nuclear industry, there is a need to provide components and/or elements for small and medium-sized reactors, and in the oil and gas industry, there is an increasing need to provide relatively large components such as pumps, valves, and manifold systems. As a consequence, when providing relatively large articles, components and/or elements as a load into a pressure vessel, the total weight of the load often is substantial. Hence, the requirements related to the handling of the load are demanding. Furthermore, the load and/or pressure vessel may be associated with relatively high costs, which even further requires a safe and reliable handling of the load.

Hence, there is a wish for an arrangement which is able to provide a safe, reliable and convenient transportation operation of a load associated with a pressure treatment of the load.

SUMMARY OF THE INVENTION

It is an object of the present invention to provide an arrangement which achieves a safe, reliable and convenient handling operation of a load associated with a pressure treatment of the load.

This and other objects are achieved by providing an arrangement and a method having the features defined in the independent claims. Preferred embodiments are defined in the dependent claims.

Hence, according to a first aspect of the present invention, there is provided an arrangement for handling a load for isostatic pressure treatment in a high-pressure arrangement. The arrangement comprises a transportation unit arranged in a first space. The transportation unit is configured for horizontal transportation of a pressure vessel comprising a load into the high-pressure arrangement before pressure treatment of the load, and out of the high-pressure arrangement after pressure treatment of the load, respectively. The arrangement further comprises an elevator unit vertically operable between the first space and a second space provided below the first space. The elevator unit is configured to lift the load from the second space into the pressure vessel before pressure treatment of the load. The elevator unit is further configured to lower the load from the pressure vessel to the second space after pressure treatment of the load, respectively.

According to a second aspect of the present invention, there is provided a method for handling a load for isostatic pressure treatment in a high-pressure arrangement. The method comprises the steps of, before pressure treatment of the load, lifting the load from a second space, provided below a first space, into a pressure vessel provided in the first space, and horizontally transporting the pressure vessel into the high-pressure arrangement. The method further comprises the steps of, after pressure treatment of the load, horizontally transporting the pressure vessel out of the high-pressure arrangement, and lowering the load from the pressure vessel to the second space after pressure treatment of the load.

Thus, the present invention is based on the idea of handling a load for isostatic pressure treatment in a high-pressure arrangement. More specifically, before pressure treatment of the load, an elevator unit is configured to lift a load vertically upwards into a pressure vessel from a second space into a first space. Thereafter, a transportation unit is configured to horizontally transport the pressure vessel comprising the load into the high-pressure arrangement. Analogously, after pressure treatment of the load, the transportation unit is configured to horizontally transport the pressure vessel comprising the load out of the high-pressure arrangement. Thereafter, the elevator unit is configured to lower the load vertically downwards from the pressure vessel from the first space into the second space. In other words, the pressure vessel comprising the load is transported in a horizontal plane into and out of the high-pressure arrangement before and after pressure treatment of the load, respectively. Before the pressure vessel is transported into the high-pressure arrangement, it is vertically lifted from a second space below the first space, by means of the elevator unit which is vertically operable. Analogously, after the pressure vessel is transported out of the high-pressure arrangement, it is vertically lowered from the first space to the second space by means of the elevator unit.

There is provided an arrangement for handling a load for isostatic pressure treatment in a high-pressure arrangement. By "load", it is here meant substantially any articles, components and/or elements for high-pressure treatment.

The arrangement comprises a transportation unit arranged in a first space. By the term "transportation unit", it is here meant a unit suitable for a transportation of (an) object(s) which may be relatively large and/or heavy.

The transportation unit is configured for horizontal transportation of a pressure vessel comprising the load into the high-pressure arrangement before pressure treatment of the load, and out of the high-pressure arrangement after pressure treatment of the load, respectively.

The arrangement further comprises an elevator unit vertically operable between the first space and a second space provided below the first space. By "elevator unit", it is here meant a (freight) elevator, lift, hoist, or the like, suitable for lifting and/or lowering of (an) object which may be relatively large and/or heavy.

The elevator unit is configured to lift the load from the second space into the pressure vessel before pressure treatment of the load. In other words, the elevator unit may be configured to raise, lift, handle and/or transport the load vertically upwards from the second space into the first space and into the pressure vessel, provided in the first space. The elevator unit is further configured to lower the load from the pressure vessel to the second space after pressure treatment of the load. In other words, the elevator unit may be configured to lower and/or transport the load vertically downwards from the pressure vessel provided in the first space to the second space. Hence, before pressure treatment, the elevator unit may be configured to lift the load into the pressure vessel which in its turn, is configured to receive the load. Analogously, after pressure treatment, the pressure vessel may be configured to release the load to the elevator unit, which in its turn, is configured to lower the load.

The present invention is advantageous in that the arrangement and method result in a safe, reliable and convenient handling and/or transportation of a load for pressure treatment. It will be appreciated that the use of an elevator unit for vertical load transportation, i.e. a lifting and/or lowering of the load along a vertical axis, is advantageous compared to other solutions in the prior art. For example, the use of overhead cranes for load transportation may lead to movements of the load in two or three dimensions, which consequently may result in an unstable, oscillating transportation of the load. It should be noted that an arrangement of this kind may be dangerous for personnel/staff operating the arrangement and/or for other persons being in the vicinity of the arrangement. Furthermore, the load may be susceptible for damage due to the unstable and/or oscillating transportation by the arrangement. The elevator unit of the present invention, on the other hand, provides a safe and stable operation by the one-dimensional lifting/lowering of the load, thereby overcoming the mentioned drawbacks and risks of the staff and/or the load itself.

The present invention is further advantageous in that the transportation unit, which is horizontally operable, provides a safe, reliable and convenient handling and/or transportation of the load. Compared to other transportation means in the prior art, which may be operable in several dimensions, the transportation unit of the present invention provides a robust one-dimensional (horizontal) transportation. It will be appreciated that the ability provided by the transportation unit of horizontally transporting a pressure vessel into the high-pressure arrangement is of particular importance having regard to the relatively large and/or heavy pressure vessels containing the load. Hence, the present invention may overcome the dangers of unsafe transportation operations, related to staff and/or equipment, according to the prior art.

The present invention is further advantageous in that the arrangement may conveniently and efficiently divide the handling of the load, on the one hand, and the handling of the pressure vessel comprising the load, on the other hand. In other words, the elevator unit of the arrangement may provide a handling (transportation, lifting) of the load, whereas the transportation unit of the arrangement may provide a transportation of the pressure vessel where the load is contained within the pressure vessel. In other words, the elevator unit of the present invention is configured to lift and/or lower the load from and/or to the second space whilst the pressure vessel may remain in the first space, provided above the second space in a vertical direction. The arrangement may hereby save cost and/or time related to the handling of the load.

According to an embodiment of the present invention, the transportation unit comprises at least one track upon which the pressure vessel is configured to be transported. By "track", it is here meant substantially any kind of guiding means such as a rail, a line, or the like. The embodiment is advantageous in that the at least one track provides a high degree of stability and safety during the transportation of the pressure vessel along the track. It will be appreciated that the present embodiment is particularly advantageous when considering that the weight of the pressure vessel may be relatively high and/or that the size of the pressure vessel may be relatively big.

According to an embodiment of the present invention, the transportation unit further comprises a carriage unit configured for transportation of the pressure vessel on the at least one track. By "carriage unit", it is here meant a wagon- or carriage-like unit suitable for transporting a pressure vessel, wherein the pressure vessel may be relatively heavy and/or large. The present embodiment is advantageous in that the carriage unit may provide an even more stable way of transporting the pressure vessel into and out of the high-pressure arrangement, respectively.

According to an embodiment of the present invention, the transportation unit comprises a pair of tracks and the carriage unit comprises a plurality of pair of wheels configured to roll on the pair of tracks. In other words, in the present embodiment, the transportation unit may comprise a pair of tracks similar to railway lines (railroad tracks) upon which one or more pairs of wheels (wheels trains/units) is/are arranged to roll upon.

According to an embodiment of the present invention, the plurality of pair of wheels are resiliently mounted to the carriage unit in a vertical direction. By the term "resiliently mounted", it is here meant that the pair of wheels are mounted to the carriage unit via one or more resilient means. The present embodiment is advantageous in that the resilient mounting of the plurality of pair of wheels may provide a safer transportation of the pressure vessel and/or load. The present embodiment is further advantageous regarding the insertion of the pressure vessel into the high-pressure arrangement before pressure treatment of the load, whereby the high-pressure arrangement, e.g. via a yoke, may push on the pairs of wheels from below such that the carriage unit holding the pressure vessel and the load may be accommodated within the high-pressure arrangement.

According to an embodiment of the present invention, the carriage unit comprises at least one locking arrangement configured to lock a movement of at least one pair of wheels in a vertical direction. The present embodiment is advantageous in that it gives the possibility to transport the carriage unit horizontally without any movement in a vertical direction, thereby maintaining a relatively constant clearance between the carriage unit and the bottom of the first space during transportation of the carriage unit.

According to an embodiment of the present invention, there is provided a system, comprising an arrangement according to any one the preceding embodiments. The system comprises a load for isostatic pressure treatment, a pressure vessel for holding the load, and a high-pressure arrangement for isostatic pressure treatment of the load held within the pressure vessel.

According to an embodiment of the present invention, the pressure vessel comprises a removable bottom lid. Before pressure treatment of the load, the elevator unit is configured to lift the bottom lid together with the load from the second space into the pressure vessel. After pressure treatment of the load, the elevator unit is configured to lower the bottom lid together with the load from the pressure vessel to the second space. The present embodiment is advantageous in that the system provides a convenient and efficient manner of bottom-loading the pressure vessel by the removable bottom lid. In other words, the system provides an insertion of the load into the pressure vessel from below by the removable bottom lid. Furthermore, the present embodiment is advantageous in that the elevator unit of the system may provide a safe and reliable insertion of the load into and out of the pressure vessel, respectively, as the bottom lid may be lifted together with the load during its insertion into the pressure vessel and lowered together with the load during its removal out of the pressure vessel.

According to an embodiment of the present invention, the system further comprises at least one second locking arrangement configured to lock the bottom lid to the pressure vessel. The present embodiment is advantageous in that the removable bottom lid may be conveniently and safely locked to the pressure vessel after insertion of the load into the pressure vessel from below.

According to an embodiment of the present invention, there is provided a pressure vessel further comprising a top lid being fixed to the pressure vessel. The present embodiment is advantageous in that the fixed top lid may provide a more reliable sealing between the top lid and the pressure vessel compared to a top lid which may be removably attached to the pressure vessel. Consequently, the present embodiment may provide a safer operation and/or higher pressure during operation of the high-pressure arrangement.

According to an embodiment of the present invention, there is provided a system according to a previously described embodiment. Before pressure treatment of the load, the plurality of pair of wheels of the carriage unit are configured to become raised in a vertical direction by the high-pressure arrangement after the transportation of the pressure vessel into the high-pressure arrangement. Furthermore, after pressure treatment of the load, the plurality of pair of wheels of the carriage unit are configured to become lowered in a vertical direction by the high-pressure arrangement before transportation of the pressure vessel out of the high-pressure arrangement. The wheels may be actively lifted when the carriage unit has been transported (moved) into the high-pressure arrangement, e.g. by means of one or more actuators. Analogously, the wheels may be actively lowered before the carriage unit is transported (moved) out of the high-pressure arrangement. Alternatively, the resiliently mounted wheels of the carriage unit may be biased by the force from the high-pressure arrangement after transportation of the pressure vessel into the high-pressure arrangement before pressure treatment of the load, such that the wheels are raised. Analogously, after pressure treatment of the load, the wheels may be lowered before transportation of the pressure vessel out of the high-pressure arrangement. The present embodiment is advantageous in that the load held within the pressure vessel may be conveniently transported on the carriage unit into and out of, respectively, the high-pressure arrangement, without the need of removing the pressure vessel from the carriage unit. Consequently, the present embodiment may lead to a time- and/or cost-efficient treatment of the load in the high-pressure arrangement.

According to an embodiment of the present invention, the system further comprises a unit comprising at least one of at least one furnace element, configured to heat a pressure medium of the high-pressure arrangement, and at least one duct, configured to guide the pressure medium, wherein the unit is attached to the inside wall of the pressure vessel. By the term "furnace element", it is here meant substantially any device, unit, element, or the like, suitable of heating a pressure medium present in the interior of the pressure vessel. By the term "duct", it is here meant substantially any channel, guiding element, tubing, or the like, suitable of guiding a pressure medium present in the interior of the pressure vessel. It will be appreciated that the unit may even be non-removably attached to the inside wall of the pressure vessel. Hence, the unit may remain attached to the pressure vessel, i.e. it does not need to be removed from the pressure vessel during insertion or removal of the load from the pressure vessel before or after treatment, respectively. Therefore, compared to an arrangement wherein (a) furnace(s) and/or (a) duct(s) need(s) to be removed before a load is removed from the pressure vessel, the present embodiment is hereby advantageous in that it contributes to an even more time and/or cost-efficient operation by the high-pressure arrangement.

According to an embodiment of the present invention, the method further comprises the step of transporting the pressure vessel into and out of, respectively, the high-pressure arrangement on at least one track.

According to an embodiment of the present invention, the method further comprises the step of, before pressure treatment of the load, lifting the bottom lid together with the load from the second space into the pressure vessel, and fastening the bottom lid to the pressure vessel. Analogously, after pressure treatment of the load, the method further comprises the step of unfastening the bottom lid from the pressure vessel, and lowering the bottom lid together with the load from the pressure vessel to the second space.

According to an embodiment of the present invention, the high-pressure arrangement comprises a transportation unit. The transportation unit, in its turn, comprises a carriage unit comprising a plurality of pair of wheels. The method comprises the step of, before pressure treatment of the load, raising the plurality of pair of wheels in a vertical direction by the high-pressure arrangement after the pressure vessel has been transported into the high-pressure arrangement. Analogously, after pressure treatment of the load, the method comprises the step of lowering the plurality of pair of wheels in a vertical direction by the high-pressure arrangement before transportation of the pressure vessel out of the high-pressure arrangement.

According to an embodiment of the present invention, a cooling arrangement is provided at least partially within the top lid. The present embodiment is advantageous in that the (fixed) top lid may hold a cooling arrangement for an efficient cooling of the pressure vessel. It will be appreciated that it is highly beneficial to provide the pressure vessel cooling in the top lid, as the warm medium within the pressure vessel during operation rises and is efficiently cooled by the cooling arrangement (e.g. including water pipes).

It will be appreciated that the specific embodiments and any additional features described above with reference to the arrangement are likewise applicable and combinable with the method according to the second aspect of the present invention.

It is to be understood that even though reference is made herein to the load being for isostatic pressure treatment, the load may according to one or more embodiments of the present invention be intended for other type(s) of pressure treatment than isostatic pressure treatment. Also, even though reference is made herein to high-pressure arrangements being for isostatic pressure treatment, it is to be understood that other types of high-pressure arrangements may be contemplated, in accordance with one or more embodiments of the present invention.

Also, any description of transportation of the load herein may be interpreted as transportation of the load and/or the pressure vessel. That is to say, any description of transportation of the load herein may be interpreted as transportation of both the load and the pressure vessel, or transportation of (possibly only) the load, or transportation of (possibly only) the pressure vessel.

Further objectives of, features of, and advantages with, the present invention will become apparent when studying the following detailed disclosure, the drawings and the appended claims. Those skilled in the art will realize that different features of the present invention can be combined to create embodiments other than those described in the following.

BRIEF DESCRIPTION OF THE DRAWINGS

The present invention will now be described in more detail, with reference to the appended drawings showing a currently preferred embodiment of the invention, wherein.

DETAILED DESCRIPTION

In the following description, the present invention is described with reference to an arrangement for handling a load for isostatic pressure treatment in a high-pressure arrangement.

Figure 1A:
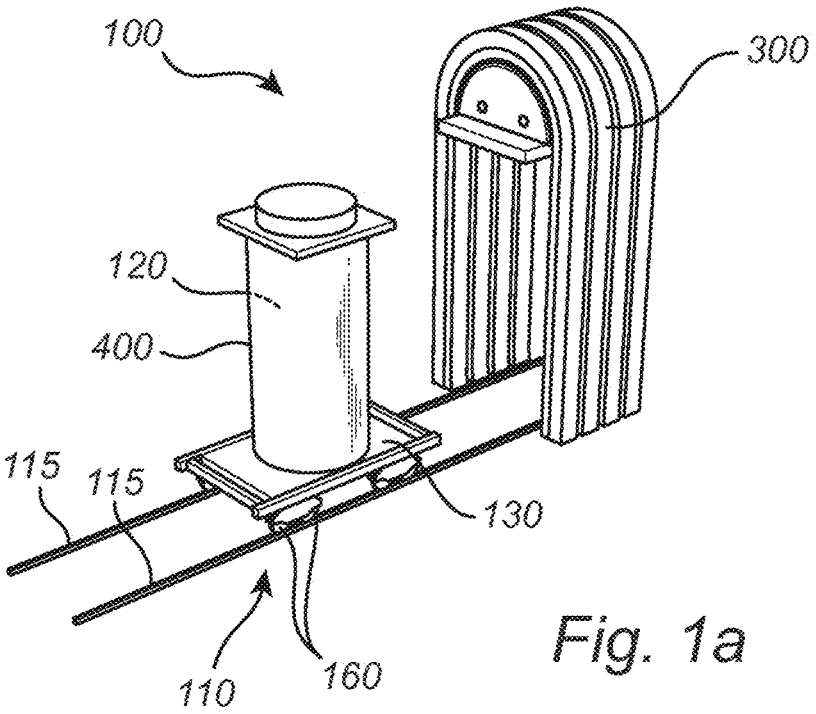
FIGS. 1*a-b* are schematic illustrations of an arrangement according to an embodiment of the present invention.

FIG. 1*a* schematically shows an arrangement 100 for handling a load 120 for isostatic pressure treatment in a high-pressure arrangement 300. The load 120, which is shown in FIG. 1*a* as a cylinder, may comprise one or more elements, articles, compositions, etc., which is (are) to be subjected to high-pressure treatment in the high-pressure arrangement 300. The load 120 is enclosed by a cylinder-shaped pressure vessel 400, i.e. the pressure vessel 400 holds the load 120. The pressure vessel 400 may have diameter of up to 4.5 m, and the diameter of the zone in which the load 120 may be provided may be up to 4 m. The weight of the pressure vessel 400 may be approximately 300 000 kilograms. The pressure vessel 400 of the high-pressure arrangement 300 may comprise means (not shown) such as one or more ports, inlets and outlets, for supplying and discharging a pressure medium. The pressure medium may be a liquid or gaseous medium with low chemical affinity in relation to the articles to be treated.

The arrangement 100 comprises a transportation unit 110. Here, the transportation unit 110 comprises a pair of parallel tracks 115 leading into the high-pressure arrangement 300 upon which tracks 115 the pressure vessel is configured to be transported. The transportation unit 110 further comprises a carriage unit 130 configured for transportation of the pressure vessel 400 and the load 120 on the pair of tracks 115. The carriage unit 130 comprises two pairs of wheels 160 configured to roll on the pair of tracks 115. It will be appreciated that the carriage unit 130 may comprise numerous pairs of wheels 160 for a safer and/or more stable transportation of the (relatively heavy) pressure vessel 400 and/or load 120. The wheels 160 may be resiliently mounted to the carriage unit 130 in a vertical direction. For example, the wheels 160 may be mounted to the carriage unit 130 via one or more coils. Hence, a force applied onto the wheels 160 from below may push the wheels 160, e.g. into a wheel housing or a cavity, of the carriage unit 130.

Figure 1B:
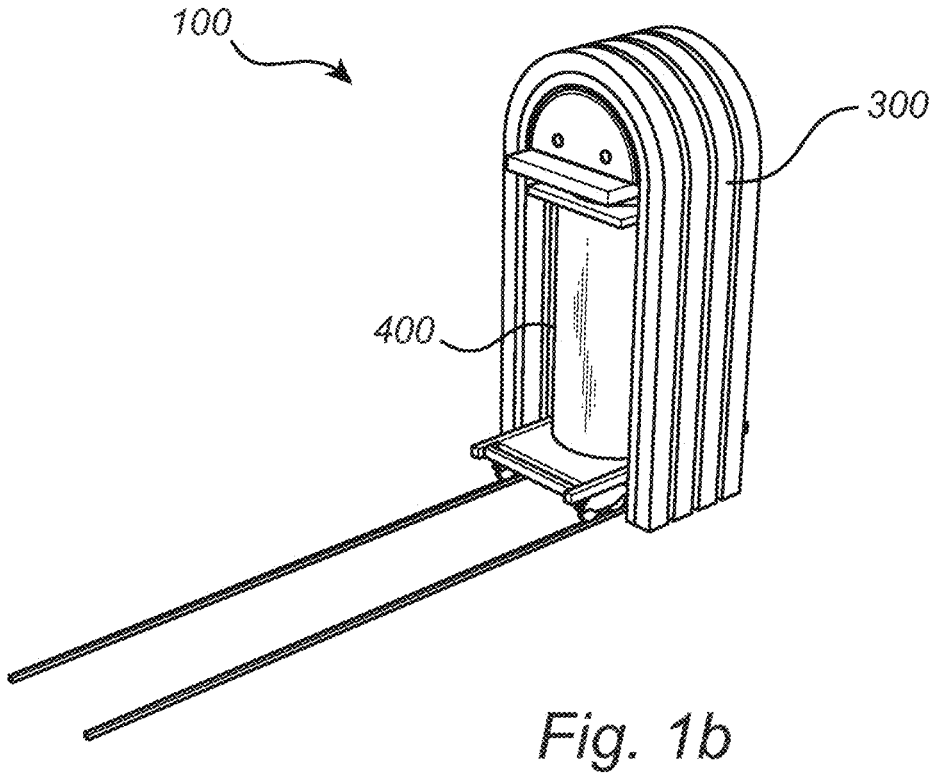

In FIG. 1*b*, the pressure vessel 400 holding the load 120 on the carriage unit 130 has been horizontally transported (to the right in FIG. 1*b*) by the transportation unit into the high-pressure arrangement 300 before pressure treatment of the load 120. Hence, in the position of the pressure vessel 400 and the load 120 in FIG. 1*b*, the load 120 is subjected to pressure treatment. After pressure treatment of the load 120, the pressure vessel 400 holding the load 120 is horizontally transported (to the left in FIG. 1*b*) out of the high-pressure arrangement 300 by the transportation unit 110.

Figure 2:
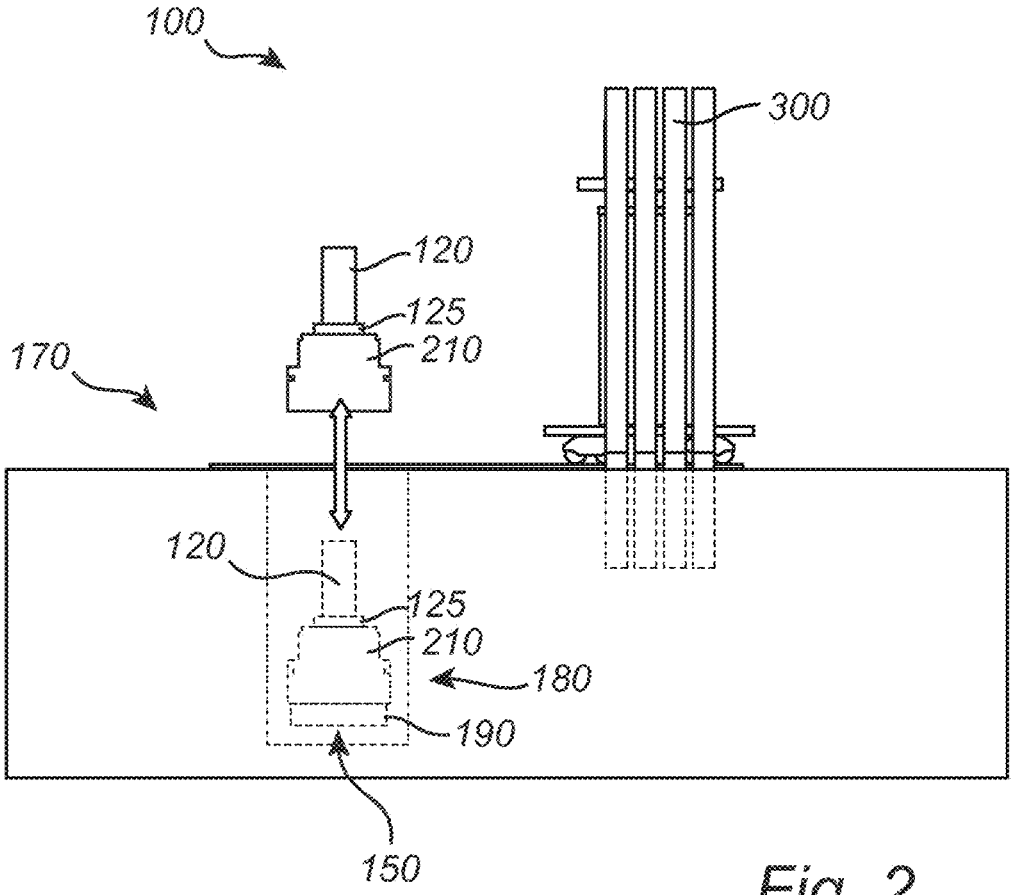
FIG. 2 is a schematic illustration of an operation of an elevator unit for handling a load for isostatic pressure treatment in a high-pressure arrangement, according to an embodiment of the present invention.

FIG. 2 schematically shows a side view of the arrangement 100 for handling a load 120 for isostatic pressure treatment in a high-pressure arrangement 300. More specifically, the load 120 is arranged on an insulating element (block) 125, which in its turn is arranged on a bottom lid 210. Furthermore, the bottom lid 210 is arranged on a base plate 190 of the elevator unit 150. In this exemplifying embodiment, a schematically indicated elevator unit 150 of the pressure arrangement 100 is vertically operable between a first space 170 and a second space 180 provided below the first space 170. The elevator unit 150 is configured to lift the load 120 from the second space 180 into the pressure vessel 400 (not shown for an increased understanding) before pressure treatment of the load 120. More specifically, before pressure treatment of the load 120, the elevator unit 150 may be configured to simultaneously lift the load 120, the insulating element 125 and the bottom lid 210, wherein these elements or components may be arranged as a stack. Analogously, the elevator unit 150 is configured to lower the load 120, the insulating element 125 and/or the bottom lid 210 from the pressure vessel 400 to the second space 180 after pressure treatment of the load.

Figure 3:
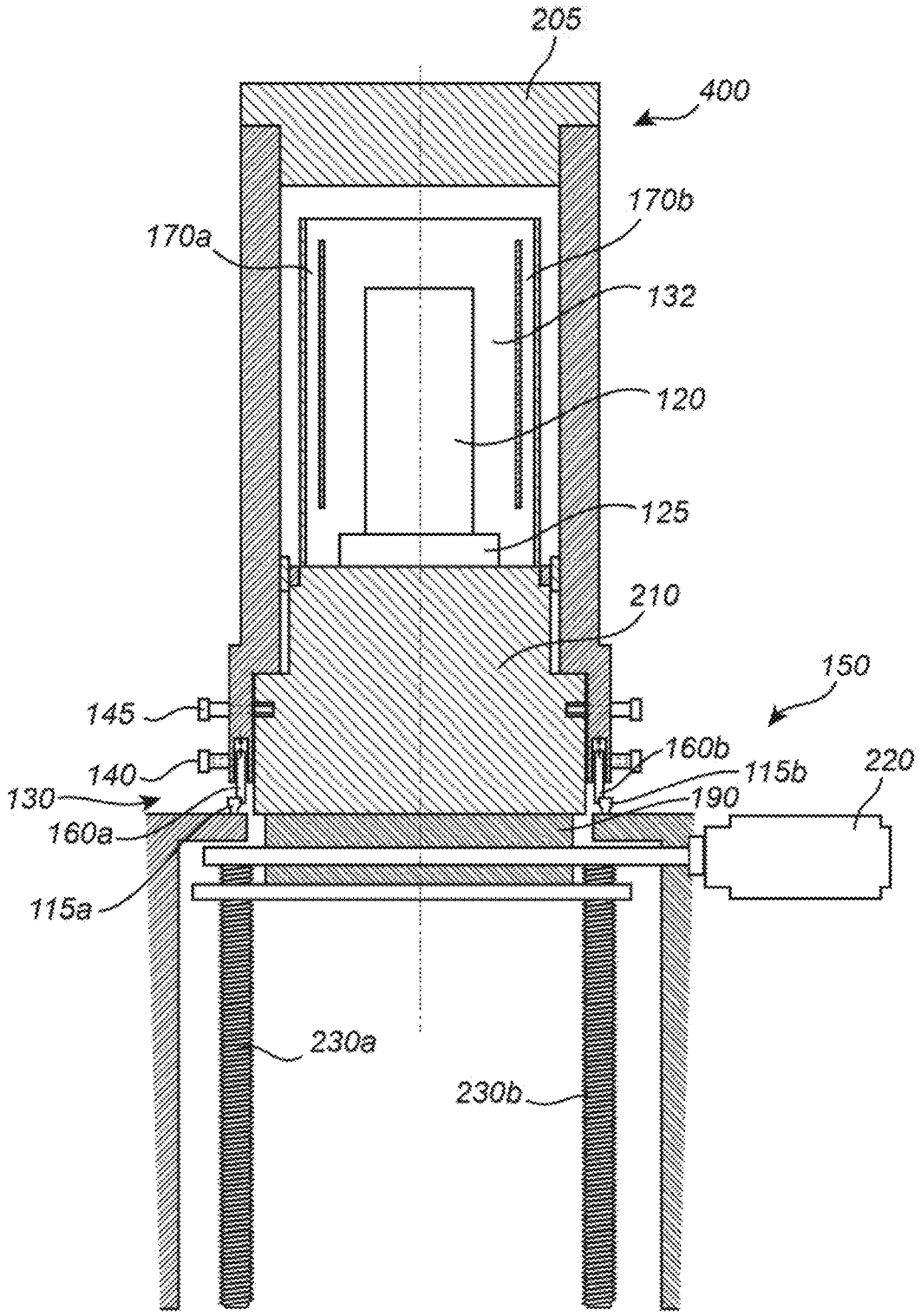
FIG. 3 is a schematic illustration of an insertion of a load for isostatic pressure treatment in a high-pressure arrangement, according to an embodiment of the present invention.

FIG. 3 schematically shows a cross section of pressure vessel 400 and the carriage unit 130 during a lifting of the load 120 into the pressure vessel 400 by means of the elevator unit 150. The elevator unit 150 comprises a motor 220 which is operably coupled to the base plate 190 of the elevator unit 150 for lifting and lowering the base plate 190. More specifically, the motor 220 is operably coupled to threaded rods 230*a,b* which are configured to lift and/or lower the base plate 190. It will be appreciated that there may be more rods (e.g. four rods, arranged at edges of a rectangular (e.g. quadratic) base plate), and that the two rods 230*a,b* are disclosed as an example for an increased understanding.

The transportation unit comprises a pair of tracks 115*a,b* and the carriage unit 130 comprises a pair of wheels 160*a,b* configured to roll on the pair of tracks 115*a,b*. The carriage unit 130 may furthermore comprise a first locking arrangement 140 configured to lock a movement of the pair of wheels 160 in a vertical direction. During transportation of the pressure vessel 400 on the carriage unit 130 into the high-pressure arrangement 300 and out of the high-pressure arrangement 300, respectively, the wheels 160 are able to be locked by the first locking arrangement 140 such that any vertical movement of the wheels 160 is impeded.

The pressure vessel 400 comprises a top lid 205 which is fixed to the pressure vessel 400. The top lid 205 may comprise a cooling arrangement (not shown) arranged to cool the pressure vessel. The cooling arrangement may comprise channels or tubes in which a coolant for cooling may be provided. The coolant is preferably water, but other coolants may also be contemplated.

The pressure vessel 400 further comprises a bottom lid 210 which is removable. In this exemplifying embodiment, the bottom lid 210 is provided between the base plate 190 and the load 120, i.e. the elevator unit 150 is configured to lift and/or lower the load 120 together with the bottom lid 210. Furthermore, and as exemplified in FIG. 3, there may be provided an insulating element (block) 125 between the bottom lid 210 and the load 120.

The carriage unit 130 comprises a second locking arrangement 145 configured to lock the bottom lid 210 to the carriage unit 130 after insertion of the load 120 into the pressure vessel 400. Analogously, the second locking arrangement 145 is also configured to unlock the bottom lid 210 to the carriage unit 130 before a lowering of the load 120 from the pressure vessel 400. The second locking arrangement 145 may have the form of a cylinder arranged to fit around the bottom lid 210 when the load 120 is inserted into the pressure vessel 400. As an example, the cylinder-shaped second locking arrangement 145 may comprise a plurality of locking units (symmetrically) distributed at its periphery, configured to lock with respectively arranged locking units of the bottom lid 210.

It will be appreciated that the pressure vessel 400 further defines a furnace chamber 132 for receiving and holding the load 120 to be treated. The furnace chamber 132 may be surrounded by a heat insulated casing (not shown) for energy-saving reasons during the heating phase.

The pressure vessel 400 furthermore comprises ducts 170*a,b* arranged vertically and adjacent the vertical walls of the furnace chamber 132 of the pressure vessel 400. The ducts 170*a,b*, which are attached to the pressure vessel 400, serve as conduits for a pressure medium during pressure treatment of the load 120. It will be appreciated that the ducts 170*a,b* are merely schematically indicated, and that the configuration of the ducts may be different than that shown in FIG. 3.

Figure 4:
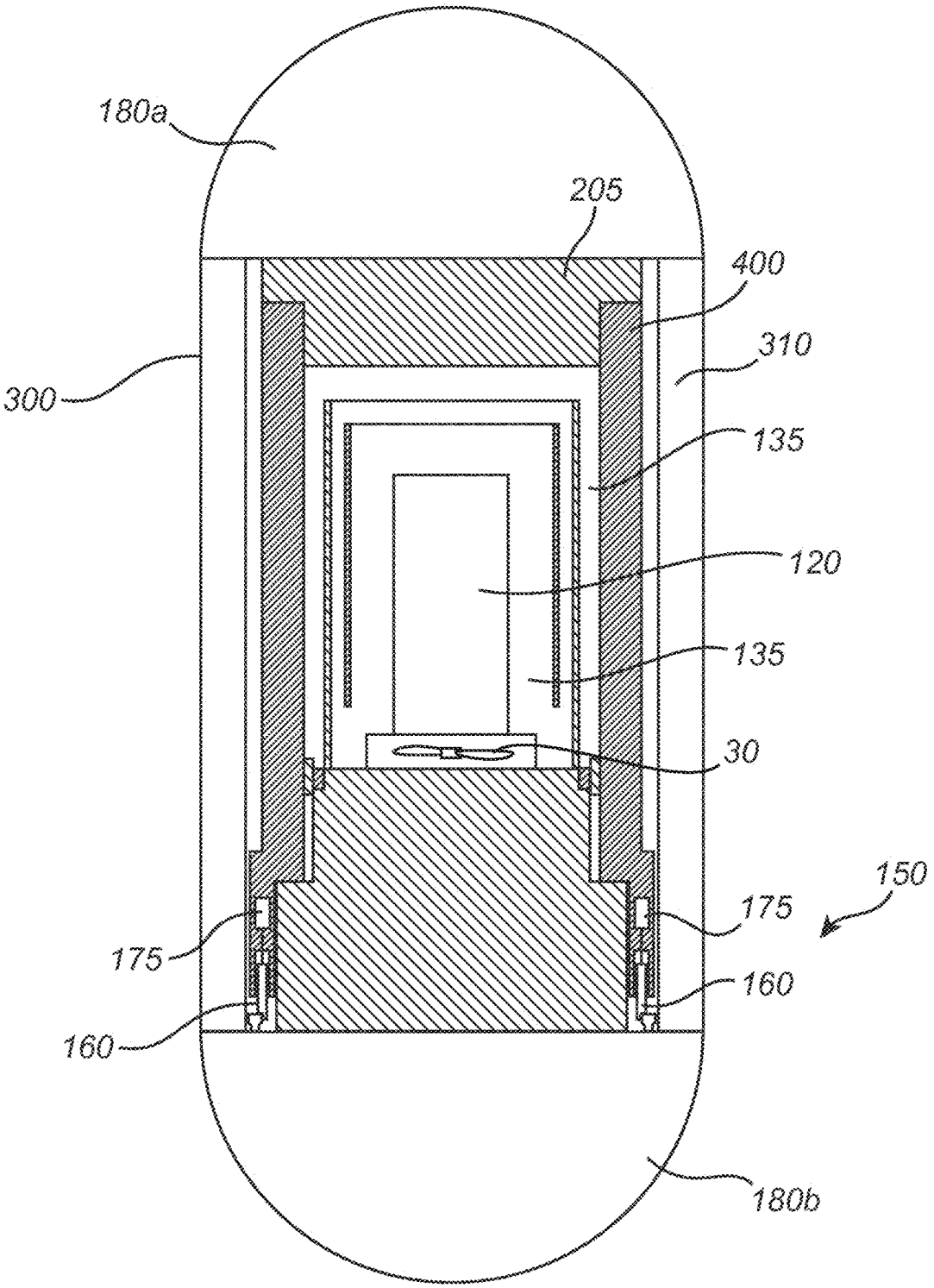
FIG. 4 is a schematic illustration of a cross section of a high-pressure arrangement, according to an embodiment of the present invention.

FIG. 4 schematically shows a cross section of a high-pressure arrangement 300 into which the pressure vessel 400 comprising the load 120 has been transported on the carriage unit 130. A fan 30 is provided for circulating pressure medium in the load compartment 135 of the high-pressure arrangement 300. It will be appreciated that some components, elements, etc., for the operation of the high-pressure arrangement 300 have been omitted, for an increased understanding.

The high-pressure arrangement 300 comprises a top (upper) yoke 180*a* and bottom (lower) yoke 180*b* which each, in cross-section, have the form of a semi-circular surface. The yokes 180*a,b* are arranged at a respective end of the high-pressure arrangement 300 and form together with the columns 310 of the arrangement 300 an internal rectangular space in which the pressure vessel 400 is provided. The columns 310 and the yokes 180*a,b* are wound with wire in several layers in order to provide pre-stress in the construction of the high-pressure arrangement 300.

After the transportation (insertion) of the pressure vessel 400 into the high-pressure arrangement 300 by means of the carriage unit 130, the bottom yoke 180*b* is configured to push on the pairs of wheels 160 of the carriage unit 130 from below. Hence, the bottom yoke 180*b* applies a vertical force on the pair of resiliently mounted wheels 160*a,b*, such that the wheels 160 are pushed into a wheel housing (or cavity) of the carriage unit 130. The wheel mounting 175 may comprise damping and/or coil elements. It will be appreciated that the high-pressure arrangement 300 of the present invention allows for an accommodation of the carriage unit 130, holding the pressure vessel 400 and the load 120, within the high-pressure arrangement 300 during pressure treatment of the load 120 by the high-pressure arrangement 300.

Analogously, after the pressure treatment of the load 120, the wheels 160 of the carriage unit 130 are configured to become lowered before transportation of the pressure vessel 400 out of the high-pressure arrangement 300. More specifically, the wheels 160 which were resiliently biased by the bottom yoke 180*b* become unbiased before the pressure vessel 400 is transported out of the high-pressure arrangement 300. Hence, the wheels 160 of the carriage unit 130 are configured to roll on the pair of tracks 115 during transportation of the pressure vessel 400 out of the high-pressure arrangement 300.

Figure 5:
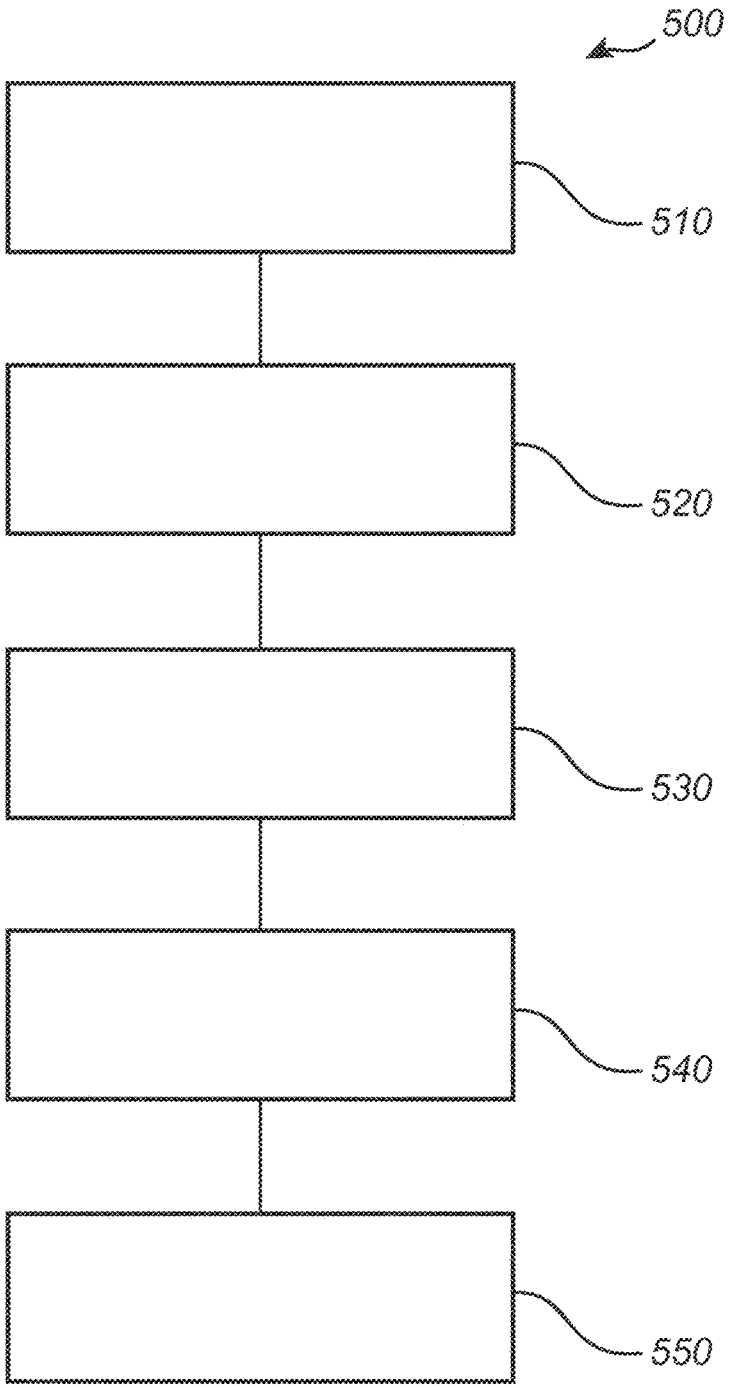
FIG. 5 is a flow chart of a method according to an embodiment of the present invention.

FIG. 5 is a flow chart of a method 500 according to an embodiment of the present invention. Before pressure treatment of the load, the method 500 comprises the steps of lifting 510 the load from a second space, provided below a first space, into a pressure vessel provided in the first space, and horizontally transporting 520 the pressure vessel into the high-pressure arrangement. It will be appreciated that the step of lifting 510 the load from the second space may comprise the step of lifting the bottom lid together with the load from the second space into the pressure vessel, and fastening the bottom lid to the pressure vessel before pressure treatment of the load.

After pressure treatment of the load, the method 500 comprises the steps of horizontally transporting 530 the pressure vessel out of the high-pressure arrangement, and lowering 540 the load from the pressure vessel to the second space after pressure treatment of the load. It will be appreciated that the step of lowering 540 the load from the pressure vessel to the second space may further comprise unfastening the bottom lid from the pressure vessel, and lowering the bottom lid together with the load from the pressure vessel to the second space after pressure treatment of the load.

Furthermore, the method 500 may comprise the steps of raising the plurality of pair of wheels in a vertical direction by the high-pressure arrangement after transportation of the pressure vessel into the high-pressure arrangement and before pressure treatment of the load. Analogously, after pressure treatment of the load, the method may comprise the step of lowering the plurality of pair of wheels in a vertical direction by the high-pressure arrangement before transportation of the pressure vessel out of the high-pressure arrangement.

Even though the invention has been described with reference to specific exemplifying embodiments thereof, many different alterations, modifications and the like will become apparent for those skilled in the art. The described embodiments are therefore not intended to limit the scope of the invention, as defined by the appended claims. For example, any sizes and/or number of units, devices or the like may be different than those described.

The invention claimed is:

1. An arrangement for handling a load for isostatic pressure treatment in a high-pressure arrangement, comprising a transportation unit arranged in a first space, wherein the transportation unit is configured for horizontal transportation of a pressure vessel comprising the load into the high-pressure arrangement before pressure treatment of the load, and out of the high-pressure arrangement after pressure treatment of the load, respectively, wherein the transportation unit comprises a pair of tracks upon which the pressure vessel is configured to be transported, a carriage unit configured for transportation of the pressure vessel on the pair of tracks, and a plurality of pair of wheels configured to roll on the pair of tracks, wherein the transportation unit is configured to lift the plurality of pair of wheels after transportation of the carriage unit into the high-pressure arrangement and to lower the plurality of pair of wheels before transportation of the carriage unit out of the high-pressure arrangement, and an elevator unit vertically operable between the first space and a second space provided below the first space, wherein the elevator unit is configured to lift the load from the second space into the pressure vessel before pressure treatment of the load, and to lower the load from the pressure vessel to the second space after pressure treatment of the load, respectively.

2. A system, comprising the arrangement according to claim 1, a load for isostatic pressure treatment, a pressure vessel for holding the load, and the high-pressure arrangement, the high-pressure arrangement configured to perform isostatic pressure treatment of the load held within the pressure vessel.

3. The system according to claim 2, wherein the pressure vessel comprises a removable bottom lid wherein before pressure treatment of the load, the elevator unit is configured to lift the bottom lid together with the load from the second space into the pressure vessel, and after pressure treatment of the load, the elevator unit is configured to lower the bottom lid together with the load from the pressure vessel to the second space.

4. The system according to claim 3, further comprising at least one second locking arrangement configured to lock the bottom lid to the pressure vessel.

5. The system according to claim 2, wherein the pressure vessel further comprises a top lid being fixed to the pressure vessel.

6. The system according to claim 2, further comprising a unit comprising at least one of at least one furnace element, configured to heat a pressure medium of the high-pressure arrangement, and at least one duct, configured to guide the pressure medium, wherein the unit is attached to an inside wall of the pressure vessel.

7. The arrangement according to claim 1, wherein the plurality of pair of wheels are resiliently mounted to the carriage unit in a vertical direction.

8. A method for handling a load for isostatic pressure treatment in a high-pressure arrangement, wherein the high-pressure arrangement comprises a transportation unit, which in turn comprises a carriage unit comprising a plurality of pair of wheels, comprising before pressure treatment of the load, lifting the load from a second space, provided below a first space, into a pressure vessel provided in the first space, horizontally transporting the pressure vessel into the high-pressure arrangement by the transportation unit, and raising the plurality of pair of wheels in a vertical direction by the high-pressure arrangement after transportation of the pressure vessel into the high-pressure arrangement, and after pressure treatment of the load, lowering the plurality of pair of wheels in the vertical direction by the high-pressure arrangement before transportation of the pressure vessel out of the high-pressure arrangement, horizontally transporting the pressure vessel out of the high-pressure arrangement by the transportation unit, and lowering the load from the pressure vessel to the second space after pressure treatment of the load.

9. The method of claim 8, further comprising, before pressure treatment of the load, lifting a bottom lid together with the load from the second space into the pressure vessel, and fastening the bottom lid to the pressure vessel, and after pressure treatment of the load, unfastening the bottom lid from the pressure vessel, and lowering the bottom lid together with the load from the pressure vessel to the second space.

* * * * *